US005384917A

United States Patent [19]

Epling

[11] Patent Number: 5,384,917

[45] Date of Patent: Jan. 31, 1995

[54] CHILD'S AUXILIARY TOILET SEAT

[76] Inventor: Wilma J. Epling, 203 Roberts St., Livingston, Tenn. 38570

[21] Appl. No.: 113,891

[22] Filed: Aug. 31, 1993

[51] Int. Cl.[6] ..... A47K 13/00

[52] U.S. Cl. ..... 4/235; 4/314; 4/661

[58] Field of Search ..... 4/235, 239, 314, 661, 4/236, 240

[56] References Cited

U.S. PATENT DOCUMENTS

| | | | |
|---|---|---|---|
| 2,392,544 | 1/1946 | Nyberg | 4/235 |
| 2,692,992 | 11/1954 | Thimmes et al. | 4/235 |
| 4,207,628 | 6/1980 | Ibel | 4/235 X |
| 4,234,974 | 11/1980 | MacDonald | 4/235 |
| 4,491,991 | 1/1985 | Herbruck | 4/239 X |
| 4,534,072 | 8/1985 | Lipski | 4/235 X |
| 4,733,419 | 3/1988 | Nee | 4/661 |
| 5,276,595 | 1/1994 | Patrie | 4/661 X |

FOREIGN PATENT DOCUMENTS

| | | | |
|---|---|---|---|
| 0007937 | 3/1897 | United Kingdom | 4/235 |

*Primary Examiner*—Charles E. Phillips

[57] ABSTRACT

A new and improved child's auxiliary toilet seat for a toilet includes a hinge pin assembly which includes a hinge pin and first hinge members connected to the toilet for receiving the hinge pin. A first toilet seat assembly has a large aperture for adults. A second toilet seat assembly includes a narrower aperture for children. The second seat portion includes a portion proximal to the water tank and a portion distal to the water tank. The second seat portion further includes a first side portion and a second side portion that extend between the proximal portion and the distal portion. The respective first side portion and the second side portion include respective leg supporting extension members which project toward each other from the respective first and second side portions, thereby narrowing the aperture for the children's use. A toilet seat cover covers the toilet seat assemblies. A signaling module may be installed on a water tank which supplies water to the toilet and may include a force-responsive assembly that is capable of sensing respective forces exerted by the toilet seat cover assembly, the second toilet seat assembly, and the first toilet seat assembly. A time signaling assembly may provide a timed interval and signal a predetermined amount of time that the second toilet seat assembly is in a lowered position for having a child seated thereon. The time signaling assembly includes a timer assembly and a sounding assembly controlled by the timer assembly.

8 Claims, 4 Drawing Sheets

CHILD'S AUXILIARY TOILET SEAT

BACKGROUND OF THE INVENTION

1. Field of the Invention

The present invention relates generally to toilet seats and, more particularly, to toilet seats especially adapted for use by small children.

2. Description of the Prior Art

After a toddler has become potty trained, the toddler is ready to use an adult size toilet. Many children are eager to make the change from the potty to the adult toilet, especially if there are older children in the family. However, because of their relatively small physical size, such toddlers are often not able to safely or comfortably sit on a standard size toilet. Some such children are so small that they are in danger of falling through the hole of the toilet seat into the toilet bowl. To avoid falling into the toilet, the child must provide additional support in some manner. Usually, the child uses the arms to brace against the toilet seat. This bracing causes their bodies to be somewhat rigid, which is counter productive to good voiding. Because of these problems, many children become reluctant to use the adult toilet and delay doing so, occasionally having accidents which are embarrassing to them and their parents.

Throughout the years, a number of innovations have been developed relating to toilet seats especially adapted for use by small children, and the following U.S. patents are representative of some of those innovations: U.S. Pat. No. 3,860,970; Des. 305,357; Des. 309,176; Des. 309,177; and Des. 326,316.

More specifically, U.S. Pat. No. 3,860,970 discloses a detachable device for partially supporting a small child on a conventional toilet seat. Most often, a child goes to the bathroom by himself. If such a detachable device were used, the child would be responsible for proper and safe installation. This may be too much to expect from a small child. In this respect, it would be desirable if a toilet seat for a small child were provided which is permanently installed on the toilet and did not have to be attached by a child.

The U.S. Pat. Nos. Des. 305,357 and Des. 309,176 combination adult and child toilet seats and covers. These patents provide a single hinge structure that supports the adult seat, the child seat, and the cover; and in this respect they are desirable. However, they do present a problem. The shape of the internal hole of the child seat appears to be very similar to the shape of the internal hole of the adult seat. This similarity of hole shapes is based on an erroneous assumption which is that the support needs of the child are the same as the support needs of the adult, except in a scaled down version for the child. This is an erroneous assumption for one major reason. With an adult, the adults feet are long enough to rest on the floor when the adult sits on the toilet seat. The feet resting on the floor assist in balancing the adult. However, for a small child, the small child's legs are often too short to permit the child's feet to reach the floor. Therefore, the child does not receive the balancing effect of the feet on the floor as does the adult. In this respect, it would be desirable if a toilet seat for a small child were provided which compensates for the fact that the child's feet do not reach the floor when the child sits on the toilet seat.

U.S. Pat. No. Des. 309,177 discloses another patent in which the shape of the hole of the child's toilet seat is the same shape as the hole of the adult's toilet seat.

U.S. Pat. No. Des. 326,316 discloses a combination child's toilet seat, adult toilet seat, and cover in which the child's toilet seat is integrated into the cover. This seat has a disadvantage in that toilet seats are often provided with decorative covers. With the child's toilet seat disclosed in this patent, a decorative cover for the toilet cover could not be used. In this respect, it would be desirable if a toilet seat for a small child were provided which permits the use of a decorative cover for the toilet seat cover.

Still other features would be desirable in a child's auxiliary toilet seat. For example, when a small child goes to the bathroom on an adult toilet, there is always the possibility that the child may get into difficulty. One indicator of difficulty would be if the child is on the toilet for an excessive period of time. In such a situation, the child may be too tired or too embarrassed to call for help. In this respect, it would be desirable if a toilet seat for a small child were provided which kept track of the time the child spent on the toilet to sound an alarm if the time is excessive.

As mentioned above, it is desirable when a child's toilet seat, an adult's toilet seat, and a toilet cover are present together on the same hinge support. With such a combined toilet seat, both adults and children are users. In certain circumstances, such as in the dark, it may be difficult to determine which component is in a lowered position and which component is in a raised position. Therefore, it would be desirable if a toilet seat for a small child were provided which provided an indication in the dark as to which components are in the down position and which are in the raised position.

Thus, while the foregoing body of prior art indicates it to be well known to use combined child and adult toilet seats, the prior art described above does not teach or suggest a child's auxiliary toilet seat which has the following combination of desirable features: (1) is permanently installed on the toilet and does not have to be attached by a child; (2) compensates for the fact that the child's feet do not reach the floor when the child sits on the toilet seat; (3) permits the use of a decorative cover for the toilet seat cover; (4) keeps track of the time the child spends on the toilet to sound an alarm if the time is excessive; and (5) provides an indication in the dark as to which components are in the down position and which are in the raised position. The foregoing desired characteristics are provided by the unique child's auxiliary toilet seat of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved child's auxiliary toilet seat for a toilet which includes a hinge pin assembly which includes a hinge pin and first hinge members connected to the toilet for receiving the hinge pin. A first toilet seat assembly includes a first seat portion and a first hinge portion for connecting to the hinge pin. The first toilet seat assembly is capable of being in a lowered orientation such that the first seat portion is supported by an upper rim of the toilet, and the first toilet seat assembly is also capable of being in a raised orientation such that the first seat portion is supported by the first hinge portion, the hinge pin, and the first hinge members.

A second toilet seat assembly includes a second seat portion and a second hinge portion for connecting to the hinge pin. The second toilet seat assembly is capable of being in a lowered orientation such that the second seat portion is supported by the first seat portion, and the second seat portion is also capable of being in a raised orientation such that the second seat portion is supported by the first hinge portion, the hinge pin, and the first hinge members.

The second seat portion includes a proximal portion which is proximal to the second hinge portion. The second seat portion also includes a distal portion which is distal to the second hinge portion. The second seat portion further includes a first side portion and a second side portion that extend between the proximal portion and the distal portion. The respective first side portion and the second side portion include respective leg supporting extension members which project toward each other from the respective first and second side portions, thereby narrowing the aperture.

A toilet seat cover assembly includes a cover portion and a third hinge portion for connecting to the hinge pin. The toilet seat cover assembly is capable of being in a lowered orientation such that the cover portion is supported by the second seat portion, and the cover portion is capable of being in a raised orientation such that the cover portion is supported by the first hinge portion, the hinge pin, and the first hinge members.

A longitudinal axis extends through the distal portion and the proximal portion, and the respective leg supporting extension members are arranged symmetrically with respect to the longitudinal axis.

A signaling module may be installed on a water tank which supplies water to the toilet. The signaling module includes a force-responsive assembly that is capable of sensing respective forces exerted by the toilet seat cover assembly, the second toilet seat assembly, and the first toilet seat assembly when the respective toilet seat cover assembly, the second toilet seat assembly, and the first toilet seat assembly are in a raised orientation.

The signaling module includes a first visual signal which indicates when the toilet seat cover assembly is in a raised orientation. A second visual signal indicates when the toilet seat cover assembly and the second toilet seat assembly are in a raised orientation. A third visual signal indicates when the toilet seat cover assembly, the second toilet seat assembly, and the first toilet seat assembly are in a raised orientation. The first visual signal is green; the second visual signal is yellow; and the third visual signal is red. The signaling module includes a bracket for hanging over an edge of the water tank that supplies water to the toilet. The force-responsive assembly includes a lever arm that is capable of being contacted by the toilet seat cover assembly.

A signaling assembly may provide a timed interval and signal a predetermined amount of time that the second toilet seat assembly is in a lowered position for having a child seated thereon. The time signaling assembly includes a timer assembly and a sounding assembly controlled by the timer assembly.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved child's auxiliary toilet seat which has all of the advantages of the prior art and none of the disadvantages.

It is another object of the present invention to provide a new and improved child's auxiliary toilet seat which may be easily and efficiently manufactured and marketed.

It is a further object of the present invention to provide a new and improved child's auxiliary toilet seat which is of durable and reliable construction.

An even further object of the present invention is to provide a new and improved child's auxiliary toilet seat which is susceptible of a low cost of manufacture with regard to both materials and labor, and which accordingly is then susceptible of low prices of sale to the consuming public, thereby making such child's auxiliary toilet seat available to the buying public.

Still yet a further object of the present invention is to provide a new and improved child's auxiliary toilet seat which is permanently installed on the toilet and does not have to be attached by a child.

Still another object of the present invention is to provide a new and improved child's auxiliary toilet seat that compensates for the fact that the child's feet do not reach the floor when the child sits on the toilet seat.

Yet another object of the present invention is to provide a new and improved child's auxiliary toilet seat which permits the use of a decorative cover for the toilet seat cover.

Even another object of the present invention is to provide a new and improved child's auxiliary toilet seat that keeps track of the time the child spends on the toilet to sound an alarm if the time is excessive.

Still a further object of the present invention is to provide a new and improved child's auxiliary toilet seat which provides an indication in the dark as to which components are in the down position and which are in the raised position.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved child's auxiliary toilet seat embodying the principles and concepts of the present invention will be described.

Figure 1:
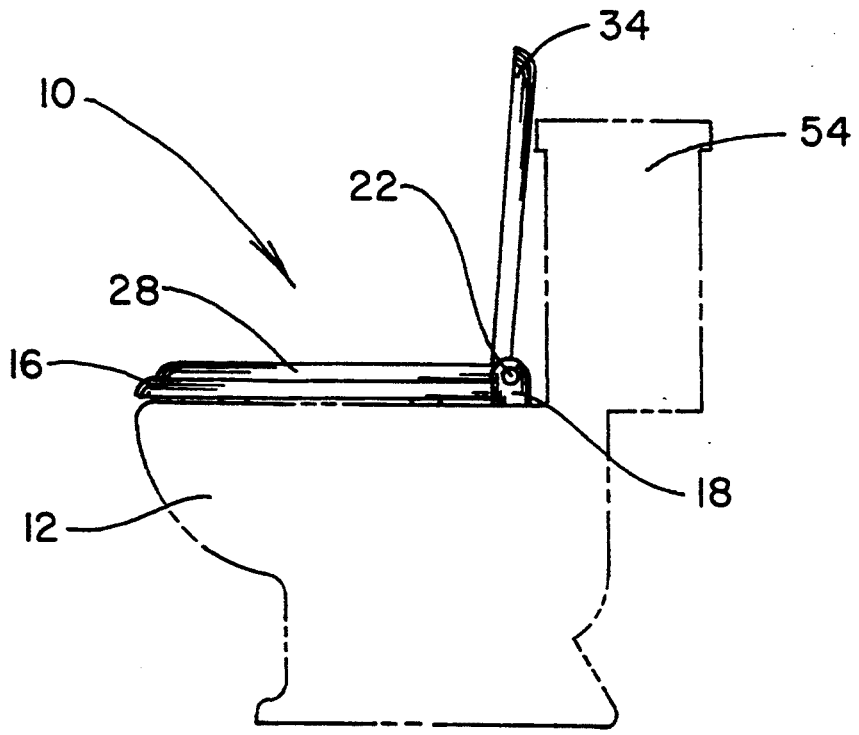
FIG. 1 is a side view showing a first preferred embodiment of the child's auxiliary toilet seat of the invention wherein toilet seat cover is in a raised position.
Figure 2:
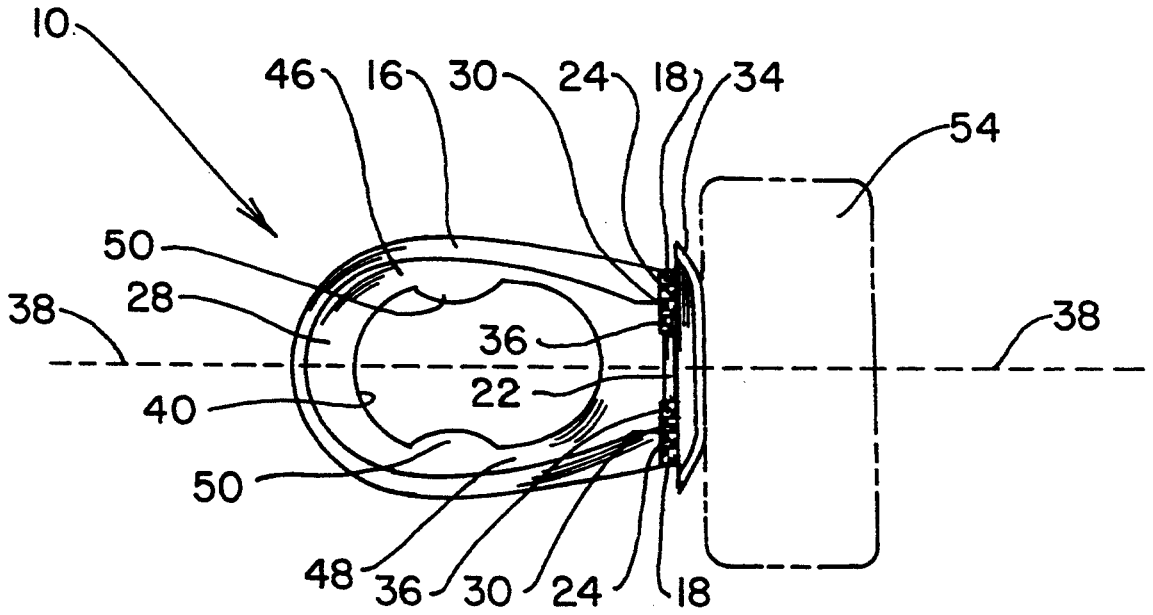
FIG. 2 is a top view of the embodiment of the child's auxiliary toilet seat shown in FIG. 1.
Figure 3:
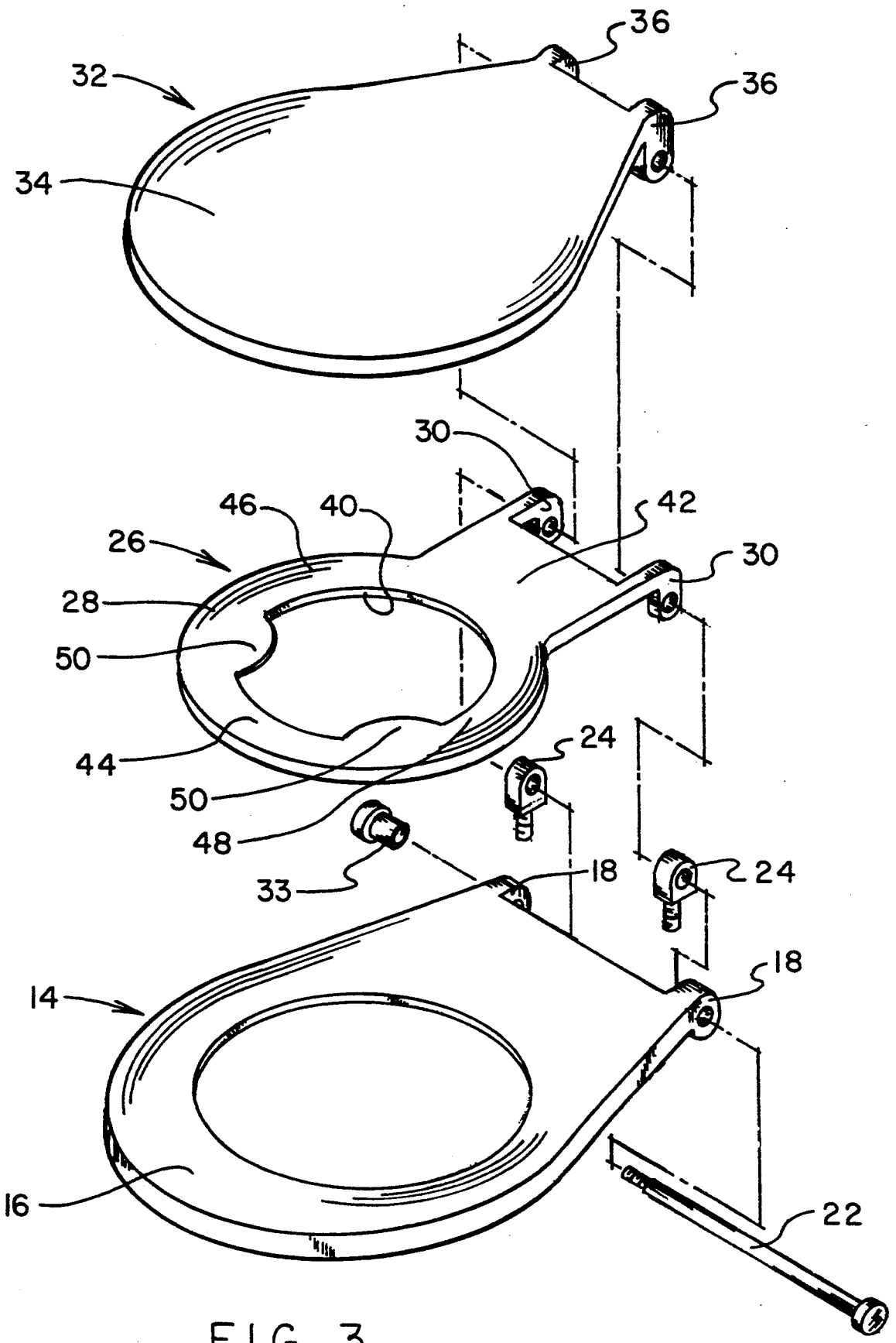
FIG. 3 is an enlarged exploded perspective view of the embodiment of the invention shown in FIG. 1.

Turning initially to FIGS. 1–3, there is shown a first exemplary embodiment of the child's auxiliary toilet seat of the invention generally designated by reference numeral 10. In its preferred form, child's auxiliary toilet seat 10 is for a toilet and includes a hinge pin assembly 20 which includes a hinge pin 22 and first hinge members 24 connected to the toilet 12 for receiving the hinge pin 22. A cap 33 screws onto the end of the hinge pin 22. Nuts screw onto threaded portions of the first hinge members 24 for securing the apparatus to the toilet 12. First toilet seat assembly 14 includes a first seat portion 16 and a first hinge portion 18 for connecting to the hinge pin 22. The first toilet seat assembly 14 is capable of being in a lowered orientation such that the first seat portion 16 is supported by an upper rim of the toilet 12, and the first toilet seat assembly 14 is also capable of being in a raised orientation (see FIG. 4) such that the first seat portion 16 is supported by the first hinge portion 18, the hinge pin 22, and the first hinge members 24.

A second toilet seat assembly 26 includes a second seat portion 28 and a second hinge portion 30 for connecting to the hinge pin 22. The second toilet seat assembly 26 is capable of being in a lowered orientation such that the second seat portion 28 is supported by the first seat portion 16, and the second seat portion 28 is also capable of being in a raised orientation (see FIG. 4) such that the second seat portion 28 is supported by the first hinge portion 18, the hinge pin 22, and the first hinge members 24.

The second seat portion 28 includes a proximal portion 42 which is proximal to the second hinge portion 30. The second seat portion 28 also includes a distal portion 44 which is distal to the second hinge portion 30. The second seat portion 28 further includes a first side portion 46 and a second side portion 48 that extend between the proximal portion 42 and the distal portion 44. The respective first side portion 46 and the second side portion 48 include respective leg supporting extension members 50 which project toward each other from the respective first and second side portions, thereby narrowing the aperture 40.

A toilet seat cover assembly 32 includes a cover portion 34 and a third hinge portion 36 for connecting to the hinge pin 22. The toilet seat cover assembly 32 is capable of being in a lowered orientation such that the cover portion 34 is supported by the second seat portion 28, and the cover portion 34 is capable of being in a raised orientation (see FIG. 4) such that the cover portion 34 is supported by the first hinge portion 18, the hinge pin 22, and the first hinge members 24. The leg supporting extension members 50 provided added support for the legs of the child when the child's legs are too short for the child's feet to reach to the floor.

A longitudinal axis 38 extends through the distal portion 44 and the proximal portion 42, and the respective leg supporting extension members 50 are arranged symmetrically with respect to the longitudinal axis 38.

Figure 4:
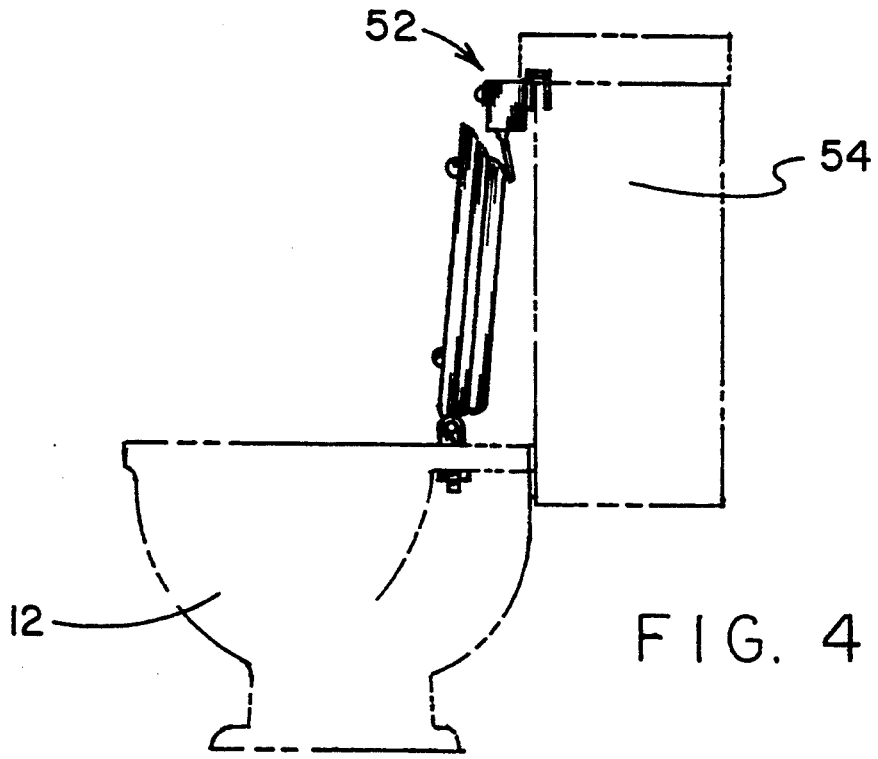
FIG. 4 is a side view showing a second preferred embodiment of the child's auxiliary toilet seat of the invention which includes a signaling module for visually signaling whether different members of the child's auxiliary toilet seat are in a raised or lowered position.
Figure 5:
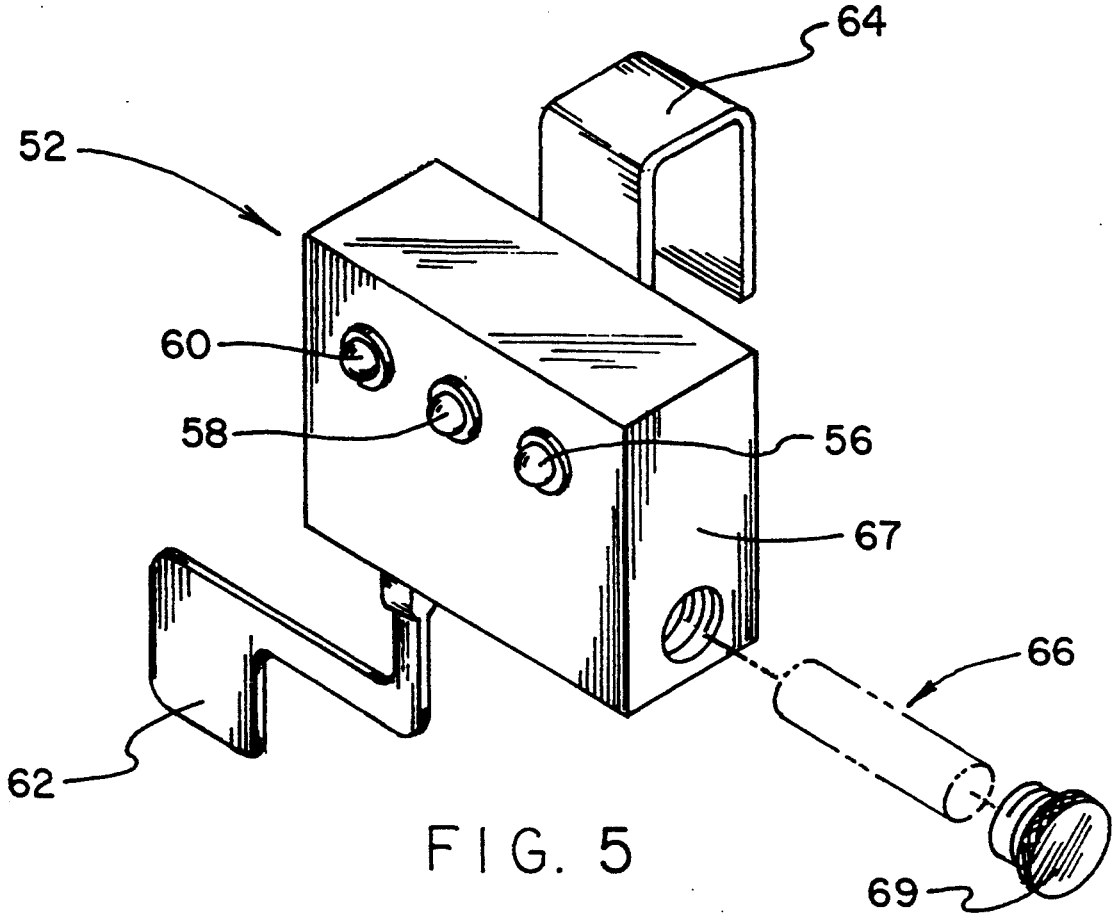
FIG. 5 is an enlarged, partially exploded perspective view of the signaling module shown in FIG. 4.

Turning to FIGS. 4–5, a second embodiment of the invention is shown. Reference numerals are shown that correspond to like reference numerals that designate like elements shown in the other figures. In addition, a signaling module 52 is installed on a water tank 54 which supplies water to the toilet 12. The signaling module 52 includes a force-responsive assembly that is capable of sensing respective forces exerted by the toilet seat cover assembly 32, the second toilet seat assembly 26, and the first toilet seat assembly 14 when the respective toilet seat cover assembly 32, the second toilet seat assembly 26, and the first toilet seat assembly 14 are in a raised orientation.

The signaling module 52 includes a first visual signal 56 which indicates when the toilet seat cover assembly 32 is in a raised orientation. A second visual signal 58 indicates when the toilet seat cover assembly 32 and the second toilet seat assembly 26 are in a raised orientation. A third visual signal 60 indicates when the toilet seat cover assembly 32, the second toilet seat assembly 26, and the first toilet seat assembly 14 are in a raised orientation. The first visual signal 56 is green; the second visual signal 58 is yellow; and the third visual signal 60 is red. The signaling module 52 includes a bracket 64 for hanging over an edge of the water tank 54 that supplies water to the toilet 12.

The force-responsive assembly includes a lever arm 62 that is capable of being contacted by the toilet seat cover assembly 32. The circuit elements for the second embodiment of the invention that is shown in FIGS. 4 and 5 are shown in FIG. 7. The only circuit elements in FIG. 7 that are not applicable to the embodiment of the invention shown in FIGS. 4 and 5 are the timer assembly 82 and the sounding assembly 84, whose functions are explained with reference to the embodiment of the invention shown in FIG. 6.

With reference to FIG. 7, the lever arm 62 has a switch contact 63 that serves as a switch in an electrical circuit powered by battery 66. In FIG. 7, the switch contact 63 of the lever arm 62 is shown in contact with switch contact 68. In this position, the electrical circuit that is completed causes the light emitting diode 60 to emit red light. The red light of the third visual signal 60 indicates the situation when the toilet seat cover assembly 32, the second toilet seat assembly 26, and the first toilet seat assembly 14 are in a raised orientation. This is a dangerous position where the bare upper edge of the toilet is exposed.

When the switch contact 70 is in contact with the switch contact 63 of the lever arm 62, the situation that exists is that the toilet seat cover assembly 32 and the second toilet seat assembly 26 are in a raised orientation. In this case, the second visual signal 58 (the yellow LED 58) is in a completed circuit and glows. In this condition, the first toilet seat assembly 14 (for the adults) is in a lowered orientation.

When the switch contact 72 is in contact with the switch contact 63 of the lever arm 62, the situation that exists is that the toilet seat cover assembly 32 is in a raised orientation, and the second toilet seat assembly 26 and the first toilet seat assembly 14 are in a lowered orientation. In this condition, the second toilet seat assembly 26 (for the child) is in position over the first toilet seat assembly 14 (for the adult). In this case, the first visual signal 56 (the green LED) is in a completed circuit and glows.

The respective red, yellow, and green visual signals are readily visible in the dark. In this way the raised or lowered condition of the respective toilet seat cover assembly 32, the second toilet seat assembly 26, and the first toilet seat assembly 14 can be ascertained in the dark. As shown in FIG. 5, the battery 66 is retained in a housing 67 by a screw cap 69.

Figure 6:
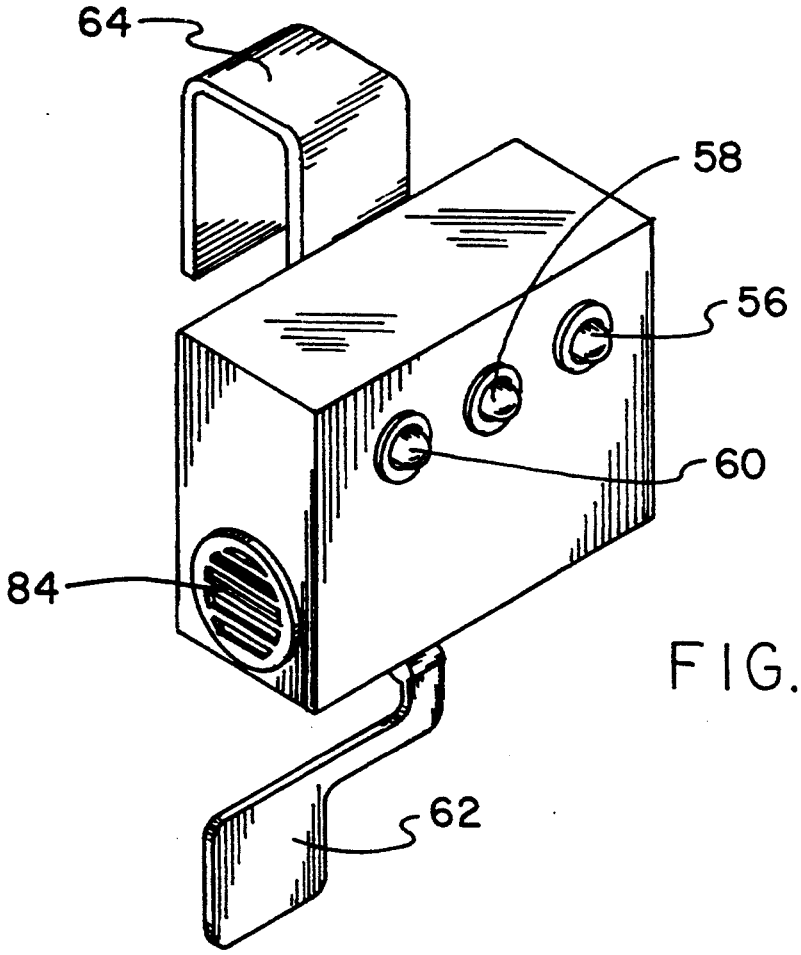
FIG. 6 is a perspective view of another signaling module for a third embodiment of the child's auxiliary toilet seat of the invention for providing an audible signal relating to the length of time the child's seat is in use.
Figure 7:
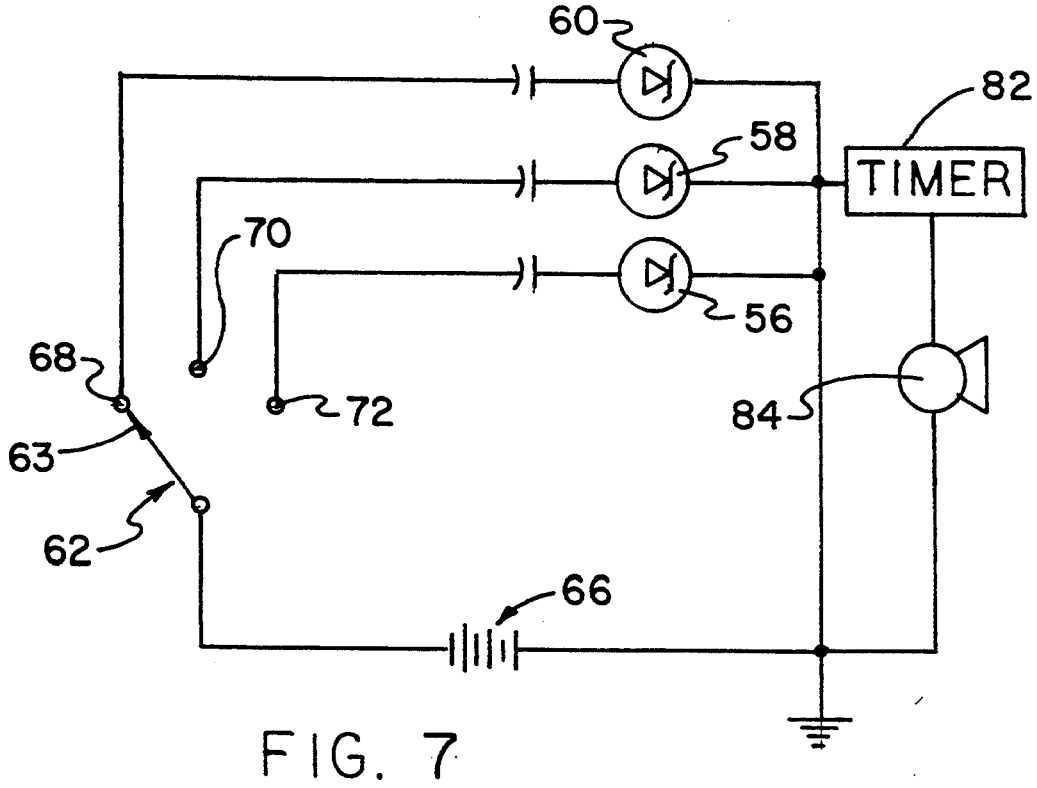
FIG. 7 is an electrical circuit diagram for the embodiments of the signaling module shown in FIGS. 5 and 6.

Turning to FIGS. 6–7, a third embodiment of the invention is shown. Reference numerals are shown that correspond to like reference numerals that designate like elements shown in the other figures. In addition, a time signaling assembly 80 which times and signals a predetermined amount of time the second toilet seat assembly 26 is in a lowered position for has a child seated thereon. The time signaling assembly 80 includes a timer assembly 82 and a sounding assembly 84 controlled by the timer assembly 82. The timer assembly 82 is started when the second toilet seat assembly 26 is in the lowered position and when the toilet seat cover assembly 32 is in a raised position. After the predetermined period of time (for example three minutes) that the timer runs expires, and the sounding assembly 84 is sounded providing an audible alarm signal indicating that the child may be has difficultly during the visit to the bathroom.

The components of the child's auxiliary toilet seat of the invention can be made from inexpensive and durable wood and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved child's auxiliary toilet seat that is low in cost, relatively simple in design and operation, and which may advantageously be used to be permanently installed on the toilet and does not have to be attached by a child. With the invention, a child's auxiliary toilet seat is provided which compensates for the fact that the child's feet do not reach the floor when the child sits on the toilet seat. With the invention, a child's auxiliary toilet seat is provided which permits the use of a decorative cover for the toilet seat cover. With the invention, a child's auxiliary toilet seat is provided which keeps track of the time the child spends on the toilet to sound an alarm if the time is excessive. With the invention, a child's auxiliary toilet seat is provided which provides an indication in the dark as to which components are in the down position and which are in the raised position.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved child's auxiliary toilet seat for a toilet, comprising:

a hinge pin assembly which includes a hinge pin and first hinge members, connected to the toilet, for receiving said hinge pin, a first toilet seat assembly which includes a first seat portion and a first hinge portion for connecting to said hinge pin, wherein said first toilet seat assembly is capable of being in a lowered orientation such that said first seat portion is supported by an upper rim of the toilet, and wherein said first toilet seat assembly is capable of being in a raised orientation such that said first seat portion is supported by said first hinge portion, said hinge pin, and said first hinge members, a second toilet seat assembly which includes a second seat portion and a second hinge portion for connecting to said hinge pin, wherein said second toilet seat assembly is capable of being in a lowered orientation such that said second seat portion is supported by said first seat portion, and wherein said second seat portion is capable of being in a raised orientation such that said second seat portion is supported by said first hinge portion, said hinge pin, and said first hinge members, wherein said second seat portion includes a proximal portion which is proximal to said second hinge portion, includes a distal portion which is distal to said second hinge portion, and includes a first side portion and a second side portion that extend between said proximal portion and said distal portion, wherein said respective first side portion and said second side portion include respective leg supporting extension members which project toward each other from said respective first and second side portions, thereby narrowing said aperture, and a toilet seat cover assembly which includes a cover portion and a third hinge portion for connecting to said hinge pin, wherein said toilet seat cover assembly is capable of being in a lowered orientation such that said cover portion is supported by said second seat portion, and wherein said cover portion is capable of being in a raised orientation such that said cover portion is supported by said first hinge portion, said hinge pin, and said first hinge members, further including:

a signaling module installed on a water tank which supplies water to the toilet, said signaling module including a force-responsive assembly that is capable of sensing respective forces exerted by said toilet seat cover assembly, said second toilet seat assembly, and said first toilet seat assembly when said respective toilet seat cover assembly, said second toilet seat assembly, and said first toilet seat assembly are in a raised orientation.

2. The apparatus described in claim 1 wherein:

a longitudinal axis extends through said distal portion and said proximal portion, and said respective leg supporting extension members are arranged symmetrically with respect to said longitudinal axis.

3. The apparatus described in claim 1 wherein said signaling module includes a bracket for hanging over an edge of the water tank.

4. The apparatus described in claim 1 wherein said force-responsive assembly includes:

a lever arm that is capable of being contacted by said toilet seat cover assembly.

5. The apparatus described in claim 1 wherein said signaling module includes:

a first visual signal indicating when said toilet seat cover assembly is in a raised orientation, a second visual signal indicating when said toilet seat cover assembly and said second toilet seat assembly are in a raised orientation, and a third visual signal indicating when said toilet seat cover assembly, said second toilet seat assembly, and said first toilet seat assembly are in a raised orientation.

6. The apparatus described in claim 5 wherein:

said first visual signal is green, said second visual signal is yellow, and said third visual signal is red.

7. The apparatus described in claim 1, further including:

a time signaling assembly which times and signals a predetermined amount of time said second toilet seat assembly is in a lowered position for having a child seated thereon.

8. The apparatus described in claim 7 wherein said time signaling assembly includes:

a timer assembly, and a sounding assembly controlled by said timer assembly.

* * * * *